United States Patent [19]

Vits

[11] Patent Number: 4,893,416

[45] Date of Patent: Jan. 16, 1990

[54] APPARATUS FOR THE CONTACTLESS GUIDING OF WEBS OF MATERIAL

[76] Inventor: Hilmar Vits, Hüschelrath 16, D-5653 Leichlingen, Fed. Rep. of Germany

[21] Appl. No.: 215,574

[22] Filed: Jul. 6, 1988

[30] Foreign Application Priority Data

Jul. 7, 1987 [DE] Fed. Rep. of Germany ..... 3722354

[51] Int. Cl.[4] ..... F26B 13/00

[52] U.S. Cl. ..... 34/156; 34/155; 34/160

[58] Field of Search ..... 34/155, 156, 120, 117, 34/41

[56] References Cited

U.S. PATENT DOCUMENTS

| | | | |
|---|---|---|---|
| 3,231,165 | 1/1966 | Wallin et al. | 226/97 |
| 3,587,177 | 6/1971 | Overly | 34/156 X |
| 4,074,841 | 2/1978 | Kramer et al. | 34/156 |

*Primary Examiner*—Henry A. Bennet
*Assistant Examiner*—John M. Sollecto
*Attorney, Agent, or Firm*—Michael L. Dunn

[57] ABSTRACT

The invention relates to an apparatus for the contactless guidance of webs of material 1. The apparatus has at least two blow nozzles 2, 3, designed as slits or rows of holes, arranged one behind the other in running direction of the web of material 1 and extending transversely to it. The blow jets of these blow nozzles 2, 3 are directed in the same direction and obliquely against the web of meterial 1. On the side towards the web of material 1, flow baffles 12, 12*a,* 12*b,* 13 are provided, of which the flow baffle 12 adjoining the rear blow nozzle 2 in running direction of the web of material 1 is curved convexly toward the web of material 1. The flow baffle 12*a,* 12*b* between the convexly curved flow baffle 12 and the front blow nozzle 3 is designed as a shock diffuser. With such an apparatus, a web of material 1 is guided free from fluttering even under difficult circumstances. This effect is further improved if the flow baffle 13 adjoining the front nozzle lip 8 of the front blow nozzle 3 is curved convexly toward the web of material 1.

11 Claims, 3 Drawing Sheets

APPARATUS FOR THE CONTACTLESS GUIDING OF WEBS OF MATERIAL

BACKGROUND OF THE INVENTION

1. Field of the Invention

The invention relates to an apparatus for the contactless guiding of webs of material having at least two blow nozzles, designed as slits or rows of holes, arranged one behind the other in running direction of the web of material and extending transversely to it. The blow jets of the nozzles are guided in the same direction and directed obliquely against the web of material and on the side towards the web of material by flow baffles, of which the flow baffle adjoining the rear blow nozzle in running direction of the web of material is curved convexly toward the web of material.

Such bearing surfaces with a flow passing over them form together with the web of material Venturi diffusers, the web of material being made to flutter by the Bernoulli effect. The fluttering can be suppressed by special measures, for example by a perforation in the bearing surface, as then additional air flowing in allows the flow to remain on the web of material, or by bearing surface suction removal, as then the flow remains only on the bearing surface. Such one-sided flows are also produced in exceptional cases if the tension of the web of material and the material weight on the one hand and the shape of the bearing surface and the flow passing over the bearing surface on the other hand are matched. However, the need for cleaning and freedom of movement in the production of a paper machine generally neither permits the above measures nor allows the conditions for specific flow circumstances to be maintained. As with a Venturi diffuser, the narrowest point between the web of material and the back of the bearing surface changes depending on the conditions, it is namely not possible for fluttering to be avoided and there is no certainty of preventing contact.

2. Discussion of Prior Art

In the case of a known apparatus of the type mentioned at the beginning, the flow baffle that runs between the convexly curved flow baffle of the rear blow nozzle and the front blow nozzle, substantially parallel to the web of material. To make the flow become turbulent, the surface of the parallel-running flow baffle may be roughened, in particular may have corrugations. No special precautions against fluttering of the web of material are taken. There is therefore the risk that the web of material will hit something (DT 19 54 880 B2).

The risk that webs of material tend to flutter over freely guided sections is particularly great at high running speeds. Investigations have shown that fluttering takes place due to flows at the edge of a material web transverse to the running direction, in areas of relatively high and low pressure. Fluttering subjects the web of material to high stresses at the edges, so that there is the risk of the web of material tearing. On paper machines having upper and lower drying cylinders, this risk exists at the freely guided sections between the upper and lower drying cylinders. At these points, there is also the difficulty of carrying away the clouds of steam produced during drying, in order that the paper web can be dried evenly over the full machine width. It has been attempted to come to grips with the fluttering problem by a disposable felt running along with the paper web over the free sections and guiding it. However, the ventilation of the felt necessary for even drying brings new problems with it.

SUMMARY OF THE INVENTION

The invention is based on the object of creating an apparatus for the contactless guiding of webs of material of the type mentioned at the beginning which ensures a flutter-free and contactless guidance of the web of material.

This object is achieved according to the invention with an apparatus of the type mentioned at the beginning by the flow baffle lying between the convexly curved flow baffle of the rear blow nozzle and the front blow nozzle being designed as an at least one-step staged diffuser (shock diffuser).

In the case of the apparatus according to the invention the effects of a bearing surface nozzle and an air cushion nozzle are combined. The web of material is stabilized by means of the blowing air, flowing over the flow baffles and by it being sucked toward the flow baffles to within a small distance from the flow baffle. On the other hand, in their direct vicinity there prevail the forces of a strong air cushion. It has been found that, with an apparatus according to the invention, both the effect of attraction and the suppression of fluttering are considerably improved in comparison with an apparatus having a flow baffle designed as a simple diffuser (Venturi diffuser). With a stepped diffuser, the back of the bearing surface of the simple diffuser is replaced by a cavity, the step, so that there is no risk of contact; furthermore, the narrowest points can be fixed at uncritical positions by the edges of the steps. These effects of the stepped diffuser can be further improved by the flow baffle, adjoining the front nozzle lip of the front blow nozzle, being convexly curved toward the web of material.

Further advantages of the apparatus according to the invention are that it is not subjected to any limitation with regard to the pressure and volume of the blowing medium supplied. It can therefore be adapted to the respective thermodynamic requirements. With high pressure and low air volume, it can be made small, so that it can also be accommodated in places where there is little space available, such as for example at the freely led sections of the paper web between the drying cylinders of a paper machine. Here its use is particularly advantageous, because it produces a multiple increase in production. The running speed of the paper machine increases because the apparatus acts as a drying nozzle with high heat transfer and dispels the clouds of steam over the full width of the web with and by means of fresh air which is introduced. As a result, the irregularity of the variation in dampness over the width of the paper web is countered. At the same time, the fluttering at the edges is restrained. It is also advantageous that the blow nozzles can be operated with unheated fresh air as the heat of the paper itself has sufficient thermal capacity for drying.

A further area of use for the apparatus according to the invention is the drying of webs of material by means of gas-heated infra red burners. In this case, they are designed for a large air volume and low pressure, because the fumes produced by the infra red burners during drying have a small volume but a high temperature. Much blowing air volume is required in order to take up the hot fumes with absorption of the water vapor produced during the drying and to reduce the mixed air thus produced to a low temperature uncritical for the discharge pipes.

Furthermore, the apparatus can be used in the inlet and/or outlet slits of the dryers in order to seal the dryer off from the outside atmosphere at the inlet and/or outlet slit.

Further advantageous developments are defined in the subclaims.

DESCRIPTION OF AN EMBODIMENT OF THE INVENTION

1. Brief Description of the Drawing

The invention is explained in more detail below with reference to the drawings representing exemplary embodiments and in which.

2. Detailed Description of the Embodiment of the Invention

Figure 1:
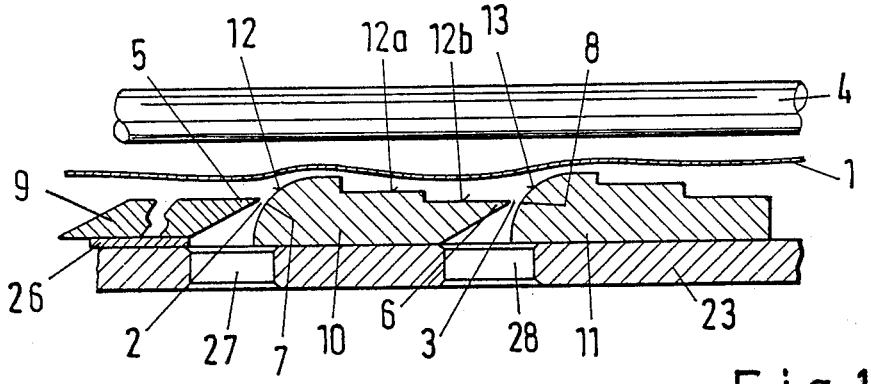
FIG. 1 shows an apparatus for the contactless guiding of a web of material, in cross-section.

The apparatus according to FIG. 1 has two blow nozzles 2, 3, designed as slits, arranged one behind the other in running direction of a web of material 1 and extending transversely to it. The blowing direction of these blow nozzles 2, 3 are directed obliquely against the web of material, in which it would be without the effect of the apparatus according to the invention on a paper machine, the so-called carrier rope 4 for the drawing-in of a paper web also runs.

The slit-shaped blow nozzles 2, 3 with their nozzle lips 5, 6, 7, 8 are formed as solid shaped pieces 9, 10, 11. The front nozzle lips 7, 8 are in each case adjoined by flow baffles 12, 13 curved convexly toward the web of material 1. The flow baffle 13 lying between the flow baffle 12 of the rear blow nozzle 2 and the rear nozzle lip 6 of the front blow nozzle 3 is designed as a shock diffuser. In the exemplary embodiment it has two steps 12*a*, 12*b*. The length of each step 12*a*, 12*b* is at least three times as great as the height of the step.

In the case of an apparatus of such design, the web of material 1 follows the path shown in the drawing. It can be seen that it is in this case guided close to the flow baffles 12, 13 and the shock diffuser 12*a*, 12*b* without touching them. This is possible because the web of material 1 is exposed to repelling and attracting forces.

Figure 2:
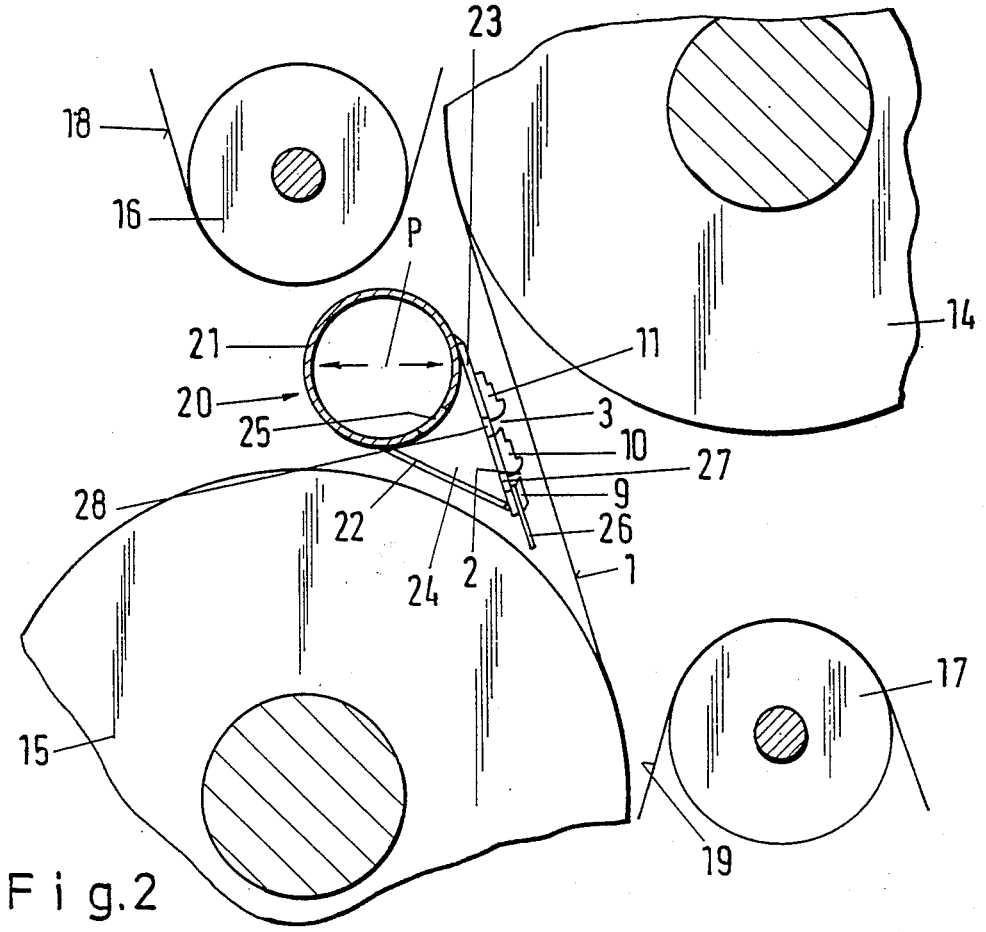
FIG. 2 shows a paper machine in cutaway section, in the region of a paper web freely guided between an upper drying cylinder and a lower drying cylinder, with an apparatus for the contactless guiding of the paper web, in diagrammatic represention in side view.

The apparatus shown in FIG. 1 is used in a paper machine according to FIG. 2, to be precise at the free section of the paper web 1 guided between an upper drying cylinder 14 and a lower drying cylinder 15. The drying cylinders 14, 15 are assigned felt guide rollers 16, 17, which guide the upper and lower felt 18, 19 running with the web.

In the free space between the upper drying cylinder 14 and the lower drying cylinder 15 there is accommodated a doctor blade 20, which is assigned to the lower drying cylinder and forms a constructional unit with the apparatus according to the invention. . Fastened to a tube 21 for the supply of blowing air and adjustable in the direction of the double-headed arrow P is a duct 24, consisting of welded-together and welded-on plates 22, 23. Blowing air is supplied to this duct 24 via openings 25 in the circumferential surface of the tube 21.

On the plate 23 facing the paper web 1 are fitted the shaped pieces 9, 10, 11 shown in FIG. 1. The shaped piece 9 comprising the nozzle lip 5 serves at the same time as clamping plate for the scraper 26 of the doctor blade. Blowing air is supplied to the blow nozzles 2, 3 from the duct 24 via openings 27, 28 in the plate 23.

Figure 3:
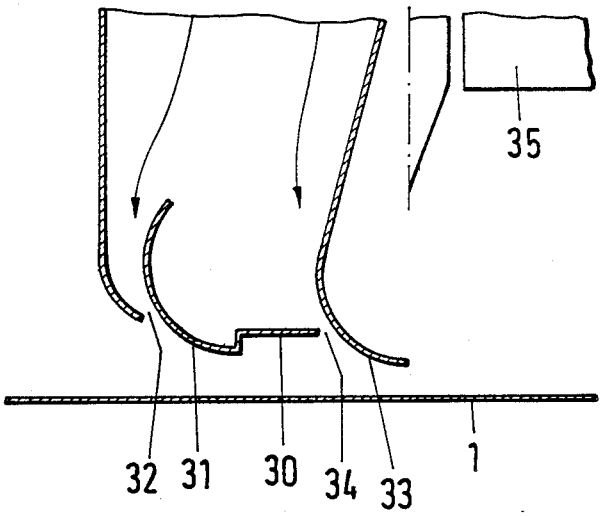
FIG. 3 shows an apparatus for the contactless guiding of a web of material in a different embodiment to that of FIG. 1, in diagrammatic representation in side view.

The exemplary embodiment of FIG. 3 differs from that of FIG. 1 essentially only in that the baffle 30 designed as shock diffuser is one-stepped and that the convexly curved flow baffle 31 of the front blowing air nozzle 32 is closer to the web of material 1 than the convexly curved flow baffle 33 of the rear blowing air nozzle 34. While the apparatus according to FIG. 1 is constructed from compact shaped pieces 9, 10, 11 and is intended for high pressures and small volumes, the apparatus according to FIG. 3 is constructed from sheet metal and is intended for small pressures and large volumes. Such apparatuses are used advantageously with gas-heated infra red radiation fields 35.

Figure 4:
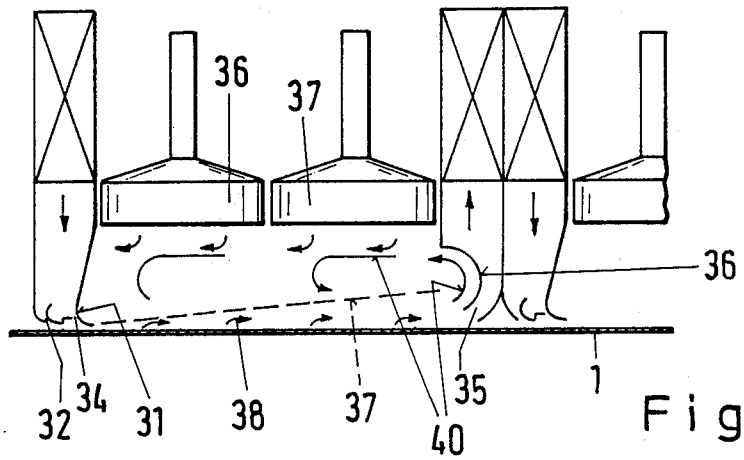
FIG. 4 shows an infra red radiation field with an apparatus according to FIG. 3, in diagrammatic representation in side view.

In the case of the exemplary embodiment of FIG. 4, two infra red radiators 36, 37 form a radiation field, at the rear edge of which in running direction of the web of material the apparatus according to FIG. 3 is arranged. At the opposite front edge, there is arranged a suction removal unit 35 for a first partial volume and a deflection and return unit 36 for another partial volume.

The blow jet blown in by the apparatus, according to the invention, into the region of the infra red radiation field diverges, as indicated by the broken line 37. At the same time, it takes up the steam 38 released from the web of material during drying. Furthermore, fumes 39 of the infra red radiation burners 36, 37 pass from the space above the broken line 37 into the blow jet. A partial volume of this blow jet, consisting of the masses of the nozzle discharge, of the steam and of the fumes, is carried away by the suction removal unit 35, while another part, consisting of the excess mass of the jet admixture, is returned in accordance with the flow arrows 40.

Figure 5:
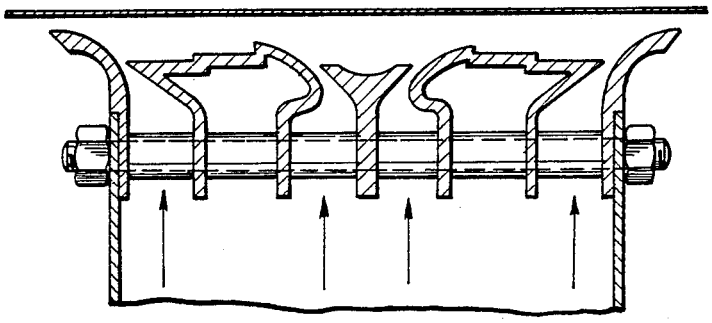
FIG. 5 shows an apparatus for the contactless guiding of the webs of material, as symmetrical double nozzle.

In the case of the exemplary embodiment of FIG. 5, which shows a double nozzle of symmetrical design, the individual nozzle has in principle the construction of that of FIG. 1. Such symmetrical double nozzles are used whenever the object is to guide a web of material in stabilized manner over a large free section and supply it with air.

Figure 6:
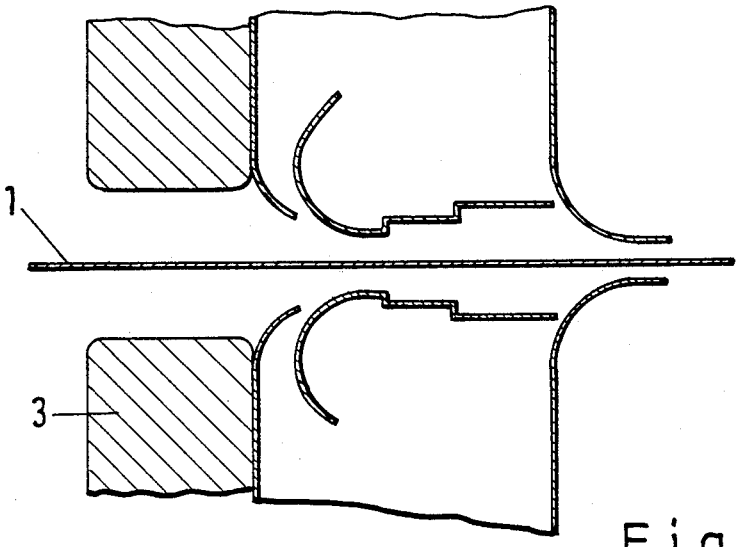
FIG. 6 shows an inlet slit of a flotation dryer having apparatuses arranged on the upper side and lower side of the slit for the contactless guiding of a web of material, in a diagrammatic representation in side view.

In the case of the exemplary embodiment of FIG. 6, an apparatus according to the invention with a two-stepped diffuser is arranged above and below the web of material. The apparatuses are arranged on the inside on the insulated end wall 41, 42 forming the inlet slit of a dryer.

What is claimed is:

1. An apparatus for the contactless guiding of webs of material comprising: at least two blow nozzles having blowjets and being arranged one behind the other in the running direction of and extending transversely to the web of material; a plurality of flow baffles being arranged in the running direction of the web of material and guiding the blowjets in the same direction and directing said blowjets obliquely against the web of material and on the side towards the web of material, said plurality of flow baffles comprising a convexly curved flow baffle and an at least one-step shock diffuser flow baffle, said convexly curved baffle adjoining a rear blow nozzle and being convexly curved towards the web of material and the shock diffuser flow baffle lying between the convexly curved flow baffle and a front blow nozzle.

2. The apparatus as claimed in claim 1, wherein the at least one step shock diffuser comprises at least one step having a length at least three times the height of the step.

3. The apparatus as claimed in claim 1, wherein the shock diffuser flow baffle comprises a front edge which forms a rear nozzle lip of the front blow nozzle.

4. The apparatus as claimed in claim 11, wherein a flow baffle adjoins a front nozzle lip of a front blow nozzle and is curved convexly toward the web of material.

5. The apparatus as claimed in claim 4, wherein the convexly curved flow baffle of the front blow nozzle lies closer to the web of material than the convexly curved flow baffle of the rear blow nozzle.

6. The apparatus as claimed in claim 1 being arranged on one side of an infra red radiation field.

7. The apparatus as claimed in claim 6, wherein, on the opposite side of the infra red radiation field, there is arranged a suction removal unit for a partial volume and a deflection and return unit for another partial volume.

8. The apparatus as claimed in claim 1 wherein the blow nozzles are slits or rows of holes.

9. The apparatus of claim 1 being incorporated in a paper machine said apparatus further comprising upper and lower drying cylinders for the web of material at a free section of the web of material formed between the upper and one of the lower drying cylinders, with a blowjet component directed in running direction of the web of material.

10. The apparatus as claimed in claim 7, wherein the apparatus is carried by the holder of an adjustable scraper on a drying cylinder.

11. The apparatus as claimed in claim 9, wherein the holder has a feed duct for the blowing medium to be fed to the blow nozzles.

* * * * *

UNITED STATES PATENT AND TRADEMARK OFFICE

CERTIFICATE OF CORRECTION

PATENT NO. : 4,893,416

DATED : January 16, 1990

INVENTOR(S) : Hilmar Vits

It is certified that error appears in the above-identified patent and that said Letters Patent is hereby corrected as shown below:

Column 5, Claim 4, line 20, delete "11" and insert in its place --1--.

Column 6, Claim 10, line 19, delete "7" and insert in its place --9--.

Column 6, Claim 11, line 22, delete "9" and insert in its place --10--.

Signed and Sealed this

Twenty-sixth Day of March, 1991

*Attest:*

HARRY F. MANBECK, JR.

*Attesting Officer*

*Commissioner of Patents and Trademarks*